US006255274B1

(12) United States Patent
Becherer et al.

(10) Patent No.: US 6,255,274 B1
(45) Date of Patent: Jul. 3, 2001

(54) USE OF COMB POLYMERS AS SOIL RELEASE POLYMERS

(75) Inventors: Johannes Becherer, Maintal; Frank-Peter Lang, Hattersheim; Bernhard Mees, Eppstein; Roman Morschhäuser, Mainz, all of (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/505,292

(22) Filed: Feb. 16, 2000

(30) Foreign Application Priority Data

Feb. 16, 1999 (DE) ..... 199 06 367

(51) Int. Cl.[7] ..... C11D 3/37

(52) U.S. Cl. ..... 510/475; 510/276; 510/346; 510/356; 510/357; 510/361; 510/414; 510/426; 510/434; 510/477; 510/488; 510/489; 510/533

(58) Field of Search ..... 510/276, 346, 510/356, 357, 361, 414, 426, 434, 475, 477, 488, 489, 533

(56) References Cited

U.S. PATENT DOCUMENTS

| | | | | |
|---|---|---|---|---|
| 4,380,527 | | 4/1983 | Graftieaux et al. | 376/245 |
| 4,427,557 | | 1/1984 | Stockburger | 252/8.7 |
| 5,691,298 | * | 11/1997 | Gosselink et al. | 510/475 |

FOREIGN PATENT DOCUMENTS

| | | | |
|---|---|---|---|
| 0 024 985 | | 3/1981 | (EP) . |
| WO 93/21294 | | 10/1993 | (WO) . |
| WO 94/03570 | | 2/1994 | (WO) . |
| WO 95/02030 | | 1/1995 | (WO) . |
| WO 99/45055 | * | 9/1999 | (WO) . |

OTHER PUBLICATIONS

Derwent Patent Family Abstract for WO 99/45055.

* cited by examiner

*Primary Examiner*—Yogendra Gupta
*Assistant Examiner*—Brian P. Mruk
(74) *Attorney, Agent, or Firm*—Miles B. Dearth; Scott E. Hanf

(57) ABSTRACT

The use of comb polymers obtained by condensation of a) a polycarboxylic acid or a polyalcohol b) one or more optionally sulfo-substituted polyalcohols having 2 to 4 OH groups or polyglycols of the formula $HO—(XO)_a—H$, in which X is $C_2H_4$ and/or $C_3H_7$ and a is a number from 2 to 35, preferably from 2 to 5, c) one or more optionally sulfonated $C_2$–$C_{10}$-dicarboxylic acids and d) one or more compounds of the formulae $NH_2R$, $NHR_2$, ROH, $R^1COOH$, $HO(XO)_b—H$ and $HO(CH_2CH_2)_d SO_3K$, in which R is $C_1$–$C_{22}$-alkyl or $C_6$–$C_{10}$-aryl, $R^1$ is $C_1$–$C_{22}$-alkyl, $C_1$–$C_{22}$-sulfoalkyl, $C_6$–$C_{10}$-aryl or $C_6$–$C_{10}$-sulfoaryl, X is $C_2H_4$ and/or $C_3H_7$, b is a number from 3 to 40, preferably 3 to 20, d is a number from 1 to 10, preferably 1 to 4, and K is a cation, as soil release polymers.

10 Claims, No Drawings

USE OF COMB POLYMERS AS SOIL RELEASE POLYMERS

FIELD OF THE INVENTION

The present invention relates to the use of soil release comb polymers in detergents and cleaning agents.

DESCRIPTION OF THE RELATED ART

Soil release polymers have for many years been the subject of intensive development work. Originally developed as textile assistants for finishing manmade fibers, in particular polyester fibers, they are now used as so-called washing aids also in detergents and cleaning agents for household laundry. Common names for such compounds having a soil-detaching capability are "soil release polymers" or "soil repellents", because they impart soil-repellent properties to the treated surfaces.

The predominant number of soil release polymers are polyesters based on terephthalic acid, polyalkylene glycols and monomer glycols.

Owing to their structural relationship, these are readily adsorbed by polyester fabrics or polyester-containing union fabrics from an aqueous solution or a wash liquor and will form a hydrophilic film on the hydrophobic fabric. As a result of this, the affinity of the fabric to hydrophobic oily and greasy dirt is reduced. At the same time, the wettability of the polyester fabric with the aqueous wash liquor is improved. Both lead to easier release of oily and greasy surface dirt, which is usually very difficult to remove from polyester fabrics. In addition, the moisture transport (water absorption and absorptivity) in the treated hydrophobic fabrics, such as polyester or polyester/cotton union fabrics, is substantially improved, which has a positive effect on the wearing properties. In addition, the soil release polymers also improve the antistatic properties and the frictional properties. This facilitates the handling of the fabrics during textile processing.

Soil release polyesters of the abovementioned type which contain anionic groups, such as, for example, sulfo groups, are also known (EP-A-24 985, U.S. Pat. No. 4,427,557, WO 94/03 570, WO 93/21 294, WO 95/02 030).

SUMMARY OF THE INVENTION

It has now been found that so-called comb polymers, as described in DE 198 09 948.7, can be used as soil release polymers.

The invention therefore relates to the use of comb polymers as soil release polymers, these comb polymers being obtained by condensation of a) a polycarboxylic acid or a polyalcohol b) one or more optionally sulfo-substituted polyalcohols having 2 to 4 OH groups or polyglycols of the formula $HO—(XO)_a—H$, in which X is $C_2H_4$ and/or $C_3H_7$ and a is a number from 2 to 35, preferably from 2 to 5, c) one or more optionally sulfonated $C_2$–$C_{10}$-dicarboxylic acids and d) one or more compounds of the formulae $NH_2R$, $NHR_2$, ROH, $R^1COOH$, $HO(XO)_b—H$ and $HO(CH_2CH_2)_d SO_3K$, in which R is $C_1$–$C_{22}$-alkyl or $C_6$–$C_{10}$-aryl, $R^1$ is $C_1$–$C_{22}$-alkyl, $C_1$–$C_{22}$-sulfoalkyl, $C_6$–$C_{10}$-aryl or $C_6$–$C_{10}$-sulfoaryl, X is $C_2H_4$ and/or $C_3H_7$, b is a number from 3 to 40, preferably 3 to 20, d is a number from 1 to 10, preferably 1 to 4, and K is a cation.

DESCRIPTION OF THE PREFERRED EMBODIMENTS

The polymeric main chain of the comb polymers according to the invention preferably comprises polymeric aliphatic, cycloaliphatic or aromatic polycarboxylic acids or derivatives thereof, such as, for example, polyacrylic acid, polymethacrylic acid, polymaleic acid, polymaleic anhydride and polynorbornenic acid or esters thereof with aliphatic, cycloaliphatic or aromatic $C_1$–$C_{22}$-alcohols. The number average molecular weights of these polycarboxylic acids may be between 1000 and 2,000,000 g/mol, with the range of 2000 to 100,000 g/mol being preferred.

Furthermore, the polymeric main chain may comprise a polymeric aliphatic, cycloaliphatic or aromatic polyalcohol, such as, for example, polyvinyl alcohol or polynorbornyl alcohol. The average molecular weights of these polyalcohols may be between 1000 and 2,000,000 g/mol, the range of 2000 to 100,000 g/mol being preferred.

In addition, random, alternating or block-type copolymers of the two abovementioned classes of compounds with other vinylic monomers, such as, for example, styrene, acrylamide, α-methylstyrene, N-vinylpyrrolidone, N-vinylpyridine, N-vinylformamide, N-vinylcaprolactone, vinyl acetate or acrylamidopropylenesulfonic acid, vinylsulfonic acid, vinylphosphonic acid and the alkali metal, alkaline earth metal and ammonium salts thereof, may also be used.

These polycarboxylic acids and polyalcohols are reacted with a mixture of the components b) to d) as defined above, oligomeric polyester side chains forming. Suitable components b) are optionally sulfo-substituted aromatic, aliphatic or cycloaliphatic polyalcohols as defined above, for example ethylene glycol, 1,2-propanediol, 1,2-butanediol, 1,4-butanediol, sodium 1,2-dihydroxypropoxyethanesulfonate, glycerol, pentaerythritol.

The component c) comprises at least difunctional aromatic, aliphatic and/or cycloaliphatic $C_2$–$C_{10}$-dicarboxylic acids, such as, for example, terephthalic acid, isophthalic acid, cyclohexanedicarboxylic acid, succinic acid, adipic acid, 2,6-naphthalenedicarboxylic acid and optionally one or more sulfonated aromatic, aliphatic or cycloaliphatic $C_3$–$C_{10}$-dicarboxylic acids, for example sulfosuccinic acid or 5-sulfoisophthalic acid or mixtures thereof.

To improve the water solubility, in the case of the components containing sulfo groups, the sulfo group is preferably present as an alkali metal, alkaline earth metal or ammonium or mono-, di-, tri- or tetraalkyl- or -hydroxyalkyl-ammonium salt, it being possible for one alkyl group to contain 1 to 22 carbon atoms and the other alkyl groups, as well as the hydroxyalkyl group, to contain 1 to 4 carbon atoms.

Component d) is a so-called endcap group. Suitable terminal groups of this type are: aromatic, aliphatic or cycloaliphatic monoalkylamines or dialkylamines, it being possible for the alkyl group to contain 1 to 22 carbon atoms; aromatic, aliphatic or cycloaliphatic monocarboxylic acids having 1 to 200 carbon atoms in the case of the aliphatic monocarboxylic acids and 6 to 10 carbon atoms in the case of the aromatic or cycloaliphatic monocarboxylic acids;

aliphatic monoalcohols having 1 to 22 carbon atoms or aromatic and cycloaliphatic monoalcohols having 6 to 10 carbon atoms;

polyalkoxy compounds of the formula $HO—(AO)_xR$, A being $—C_2H_4—$ or $—C_3H_7—$, x being a number from 3 to 40, preferably 3 to 20, and R being hydrogen or $C_1$–$C_{22}$-alkyl.

Sulfonated mono- or polyethylene glycols of the formula $H(OCH_2CH_2)_dSO_3M$, d being a number from 1 to 10, preferably from 1 to 4, and M being an alkali metal or alkaline earth metal cation, are particularly preferred as component e). The comb polymers according to the invention may alternatively also be free of components according to d). In this case, the side chains of the comb polymer are terminated by a hydrogen atom.

The comb polymers preferably comprise 0.5 to 10% by weight of the component a), 15 to 45% by weight of the component b), 30 to 70% by weight of the component c) and 10 to 30% by weight of the component d).

The number average molecular weights of the comb polymers may advantageously be between 2000 and 2,000,000 g/mol, particularly advantageously between 2000 and 100,000 g/mol, the range of 2000–30,000 g/mol preferably being used, very particularly advantageously 5000–15,000 g/mol.

The synthesis of the comb polymers is carried out by processes known per se, by first heating the components a) to d) to temperatures of 160 to about 220° C. at atmospheric pressure with the addition of a catalyst. The reaction is then continued under reduced pressure at temperatures of 160 to about 240° C. with removal of excess glycols by-distillation. The known transesterification and condensation catalysts of the prior art, such as, for example, titanium tetraisopropylate, dibutyltin oxide or antimony trioxide/calcium acetate, are suitable for the reaction. Regarding further details for carrying out the process, reference is made to EP-442 101.

The invention also relates to the use of these comb polymers in detergents and cleaning agents, in particular for increasing their cleaning power with respect to oily and greasy surface dirt.

The detergent and cleaning agent formulations in which the comb polymers according to the invention can be used are pulverulent, granular, pasty, gel-like or liquid. Examples of these are heavy-duty detergents, mild detergents, color detergents, wool detergents, detergents for drapes, modular detergents, detergent tablets, bar soaps, stain removers, starchers and crispers and ironing aids. They contain at least 0.1%, preferably between 0.1 and 10% and particularly preferably 0.2 to 3% of the comb polymers according to the invention. Depending on their intended use, the formulations should be adapted in their composition to the type of textiles to be washed or to the surfaces to be cleaned. They contain conventional detergent and cleaning agent ingredients, such as those which correspond to the prior art. Representative examples of such detergent and cleaning agent ingredients are described below.

The total concentration of surfactants in the finished detergent and cleaning agent formulation may be from 1 to 99% and preferably from 5 to 80% (all % by weight). The surfactants used may be anionic, nonionic, amphoteric and cationic. Mixtures of said surfactants may also be used. Preferred detergent and cleaning agent formulations contain anionic and/or nonionic surfactants and mixtures thereof with further surfactants.

Suitable anionic surfactants are sulfates, sulfonates, carboxylates, phosphates and mixtures thereof. Suitable cations here are alkali metals, such as, for example, sodium or potassium, or alkaline earth metals, such as, for example, calcium or magnesium, and ammonium, substituted ammonium compounds, including mono-, di- or triethanolammonium cations, and mixtures thereof. The following types of anionic surfactants are of particular interest:

Alkyl ester sulfonates, alkylsulfates, alkyl ether sulfates, alkylbenzenesulfonates, alkanesulfonates and soaps, as described below.

Alkyl ester sulfonates are, inter alia, linear esters of $C_8$–$C_{20}$-carboxylic acids (i.e. fatty acids) which are sulfonated by means of gaseous $SO_3$, as described in "The Journal of the American Oil Chemists Society" 52 (1975), pp. 323–329. Suitable starting materials are natural fats, such as, for example, tallow, coconut oil and palm oil, but may also be of synthetic nature. Preferred alkyl ester sulfonates, especially for detergent applications, are compounds of the formula

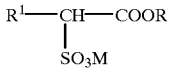

in which $R^1$ is a $C_8$–$C_{20}$-hydrocarbon radical, preferably alkyl, and R is a $C_1$–$C_6$-hydrocarbon radical, preferably alkyl. M is a cation which forms a water-soluble salt with the alkyl ester sulfonate. Suitable cations are sodium, potassium, lithium or ammonium cations, such as monoethanolamine, diethanolamine and triethanolamine. Preferably, $R^1$ is $C_{10}$–$C_{16}$-alkyl and R is methyl, ethyl or isopropyl. Methyl ester sulfonates in which $R^1$ is $C_{10}$–$C_{16}$-alkyl are particularly preferred.

Here, alkylsulfates are water-soluble salts or acids of the formula $ROSO_3M$, in which R is a $C_{10}$–$C_{24}$-hydrocarbon radical, preferably an alkyl or hydroxyalkyl radical having a $C_{10}$–$C_{20}$-alkyl component, particularly preferably a $C_{12}$–$C_{18}$-alkyl or hydroxyalkyl radical. M is hydrogen or a cation, e.g. an alkali metal cation (e.g. sodium, potassium or lithium) or ammonium or substituted ammonium, e.g. methyl-, dimethyl- and trimethylammonium cations and quaternary ammonium cations, such as tetramethylammonium and dimethylpiperidinium cations and quaternary ammonium cations derived from alkylamines, such as ethylamine, diethylamine, triethylamine and mixtures thereof. $C_{12}$–$C_{16}$-Alkyl chains are preferred for low washing temperatures (e.g. below about 50° C.) and $C_{16}$–$C_{18}$-alkyl chains for higher washing temperatures (e.g. above about 50° C.).

Alkyl ether sulfates are water-soluble salts or acids of the formula $RO(A)_mSO_3M$, in which R is an unsubstituted $C_{10}$–$C_{24}$-alkyl or hydroxyalkyl radical, preferably $C_{12}$–$C_{20}$-alkyl or hydroxyalkyl radical, particularly preferably $C_{12}$–$C_{18}$-alkyl or hydroxyalkyl radical. A is an ethoxy or propoxy unit, m is a number greater than 0, preferably between about 0.5 and about 6, particularly preferably between about 0.5 and about 3, and M is a hydrogen atom or a cation, such as, for example, sodium, potassium, lithium, calcium, magnesium, ammonium or a substituted ammonium cation. Specific examples of substituted ammonium cations are methyl-, dimethyl- and trimethylammonium cations and quaternary ammonium cations, such as tetramethylammonium and dimethylpiperidinium cations, and those which are derived from alkylamines, such as ethylamine, diethylamine, triethylamine or mixtures thereof. Examples which may be mentioned are $C_{12}$- to $C_{28}$-fatty alcohol ether sulfates in which the content of EO is 1, 2, 2.5, 3 or 4 mol per mol of the fatty alcohol ether sulfate and in which M is sodium or potassium.

In secondary alkanesulfonates, the alkyl group may be either saturated or unsaturated, branched or linear and optionally substituted by a hydroxyl group. The sulfo group may be in any position of the carbon chain, the primary methyl groups having no sulfonate groups at the beginning of the chain and end of the chain. The preferred secondary alkanesulfonates contain linear alkyl chains having 9 to 25 carbon atoms, preferably about 10 to about 20 carbon atoms, particularly preferably about 13 to 17 carbon atoms. The cation is, for example, sodium, potassium, ammonium, mono-, di- or triethanolammonium, calcium, magnesium, and mixtures thereof. A preferred cation is sodium.

In addition to secondary alkanesulfonates, primary alkanesulfonates may also be used in the detergents and cleanings agents according to the invention.

The preferred alkyl chains and cations correspond to those of the secondary alkanesulfonates.

The preparation of primary alkanesulfonates from which the corresponding sulfonates effective as a surfactant are obtained is described, for example, in EP 854 136-A1.

Further suitable anionic surfactants are alkenyl- or alkylbenzenesulfonates. The alkenyl or alkyl group may be branched or linear and optionally substituted by a hydroxyl group. The preferred alkylbenzenesulfonates contain linear alkyl chains having about 9 to 25 carbon atoms, preferably from about 10 to about 13 carbon atoms, and the cation is sodium, potassium, ammonium, mono-, di- or triethanolammonium, calcium or magnesium and mixtures thereof. Magnesium is preferred as a cation for mild surfactants systems, whereas sodium is preferred for standard washing applications. The same applies to alkenylbenzenesulfonates. The term anionic surfactants also includes olefin-sulfonates, which are obtained by sulfonization of $C_{12}$–$C_{24}$-α-olefins, preferably $C_{14}$–$C_{16}$-α-olefins, with sulfur trioxide and subsequent neutralization. Owing to the preparation process, these olefin-sulfonates may contain relatively small amounts of hydroxyalkanesulfonates and alkanedisulfonates. Special mixtures of α-olefin-sulfonates are described in U.S. Pat. No. 3,332,880.

Further preferred anionic surfactants are carboxylates, for example fatty acid soaps and comparable surfactants. The soaps may be saturated or unsaturated and may contain various substituents, such as hydroxyl groups or α-sulfonate groups. Linear saturated or unsaturated hydrocarbon radicals having about 6 to about 30, preferably about 10 to about 18 carbon atoms are preferred as the hydrophobic moiety.

Suitable anionic surfactants are furthermore salts of acylaminocarboxylic acids, the acyl sarcosinates formed by reacting fatty acid chlorides with sodium sarcosinate in an alkaline medium; fatty acid/protein condensates, which are obtained by reacting fatty acid chlorides with oligopeptides; salts of alkylsulfamidocarboxylic acids, salts of alkyl- and alkylaryl ethercarboxylic acids; $C_8$–$C_{24}$-olefinsulfonates, sulfonated polycarboxylic acids prepared by sulfonating the pyrolysis products of alkaline earth metal citrates, as described, for example, in GB-1,082,179; alkyl glycerylsulfates, oleyl glycerylsulfates, alkylphenol ether sulfates, primary paraffinsulfonates, alkyl phosphates, alkyl ether phosphates, isothionates, such as acyl isothionates, N-acyltaurides, alkyl succinates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acyl sarcosinates, sulfates of alkylpolysaccharides, such as sulfates of alkylpolyglycosides, branched primary alkylsulfates and alkylpolyethoxycarboxylates, such as those of the formula $RO(CH_2CH_2)_kCH_2COO^-M^+$, in which R is $C_8$- to $C_{22}$-alkyl, k is a number from 0 to 10 and M is a cation, resin acids or hydrogenated resin acids, such as rosin or hydrogenated rosin, or tall oil resins and tall oil resin acids. Further examples are described in "Surface Active Agents and Detergents" (Vol. I and II, Schwartz, Perry and Berch).

Suitable nonionic surfactants are, for example, the following compounds: polyethylene oxide, polypropylene oxide and polybutylene oxide condensates of alkylphenols.

These compounds include the condensates of alkylphenols having a $C_6$- to $C_{20}$-alkyl group, which may be either linear or branched, with alkene oxides. Compounds having about 5 to 25 mol of alkene oxide per mol of alkylphenol are preferred. Commercially available surfactants of this type are, for example, lgepal® CO-630, Triton® X-45, X-114, X-100 and X-102, and the ®Arkopal-N grades from Clariant GmbH. These surfactants are designated as alkylphenol alkoxylates, e.g. alkylphenol ethoxylates.

Condensates of aliphatic alcohols with about 1 to about 25 mol of ethylene oxide.

The alkyl chain of the aliphatic alcohols may be linear or branched, primary or secondary and contains in general about 8 to about 22 carbon atoms. The condensates of $C_{10}$- to $C_{20}$-alcohols with about 2 to about 18 mol of ethylene oxide per mol of alcohol are particularly preferred. The alkyl chain may be saturated or unsaturated. The alcohol ethoxylates may have a narrow ("narrow range ethoxylates") or a broad homolog distribution of the ethylene oxide ("broad range ethoxylates"). Examples of commercially available nonionic surfactants of this type are Tergitol® 15-S-9 (condensate of a linear secondary $C_{11}$–$C_{15}$-alcohol with 9 mol of ethylene oxide) and Tergitol® 24-L-NMW (condensate of a linear primary $C_{12}$–$C_{14}$-alcohol with 6 mol of ethylene oxide and a narrow molecular weight distribution). The Genapol® grades from Clariant GmbH are also among this class of products.

Condensates of ethylene oxide with hydrophobic basis, formed by condensation of propylene oxide with propylene glycol.

The hydrophobic moiety of these compounds preferably has a molecular weight of between about 1500 and about 1800. The addition reaction of ethylene oxide with this hydrophobic moiety leads to an improvement in the water solubility. The product is liquid up to a polyoxyethylene content of about 50% of the total weight of the condensate, which corresponds to condensation with up to about 40 mol of ethylene oxide. Commercially available examples of this class of products are the Pluronic® grades from BASF and the ®Genapol grades from Clariant GmbH.

Condensates of ethylene oxide with a reaction product of propylene oxide and ethylenediamine.

The hydrophobic unit of these compounds comprises the reaction product of ethylenediamine with excess propylene oxide and has in general a molecular weight of about 2500 to 3000. Ethylene oxide is subjected to an addition reaction with this hydrophobic unit up to a polyoxyethylene content of about 40 to about 80% by weight and a molecular weight of about 5000 to 11,000. Commercially available examples of this class of compound are the ®Tetronic grades from BASF and the ®Genapol PN grades from Clariant GmbH.

Semipolar Nonionic Surfactants

This category of nonionic compounds comprises water-soluble amine oxides, water-soluble phosphine oxides and water-soluble sulfoxides, each having an alkyl radical of about 10 to about 18 carbon atoms. Other semipolar nonionic surfactants are amine oxides of the formula $$R(OR^2)_xN(\overset{\uparrow}{O})(R^1)_2$$

Here, R is an alkyl, hydroxyalkyl or alkylphenol group having a chain length of about 8 to about 22 carbon atoms, $R^2$ is an alkylene or hydroxyalkylene group having about 2 or 3 carbon atoms or a mixture thereof, each radical $R^1$ is an alkyl or hydroxyalkyl group having about 1 to about 3 carbon atoms or a polyethylene oxide group having about 1 to about 3 ethylene oxide units and x is a number from 0 to about 10. The $R^1$ groups may be linked to one another via an oxygen or nitrogen atom and may thus form a ring. Amine oxides of this type are in particular $C_{10}$–$C_{18}$-alkyldimethylamine oxides and $C_8$–$C_{12}$-alkoxyethyldihydroxyethylamine oxides.

Fatty Acid Amides

Fatty acid amides of the formula

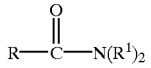

in which R is an alkyl group having about 7 to about 21, preferably about 9 to about 17, carbon atoms and each radical $R^1$ is hydrogen, $C_1$–$C_4$-alkyl, $C_1$–$C_4$-hydroxyalkyl or $(C_2H_4O)_xH$, x varying from about 1 to about 3. $C_8$–$C_{20}$-Amides, $C_8$–$C_{20}$-monoethanolamides, $C_8$–$C_{20}$-diethanolamides and $C_8$–$C_{20}$-isopropanolamides are preferred.

Further suitable nonionic surfactants are alkyl- and alkenyloligoglycosides and fatty acid polyglycol esters of fatty amine polyglycol esters, each having 8 to 20, preferably 12 to 18, carbon atoms in the fatty alkyl radical, alkoxylated triglycamides, mixed ethers or mixed formyls, alkyloligoglycosides, alkenyloligoglycosides, fatty acid N-alkylglucamides, phosphine oxides, dialkyl sulfoxides and protein hydrolysis products.

Typical examples of amphoteric and zwitterionic surfactants are alkylbetaines, alkylamidobetaines, aminopropionates, aminoglycinates or amphoteric imidazolinium compounds of the formula

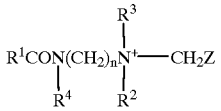

in which $R^1$ is $C_8$–$C_{22}$-alkyl or $C_8$–$C_{22}$-alkenyl, $R^2$ is hydrogen or $CH_2CO_2M$, $R^3$ is $CH_2CH_2OH$ or $CH_2CH_2OCH_2CO_2M$, $R^4$ is hydrogen, $CH_2CH_2OH$ or $CH_2CH_2COOM$, Z is $CO_2M$ or $CH_2CO_2M$, n is 2 or 3, preferably 2, M is hydrogen or a cation, such as an alkali metal, an alkaline earth metal, or alkanolammonium.

Preferred amphoteric surfactants of this formula are monocarboxylates and dicarboxylates. Examples of these are cocoamphocarboxypropionate, cocoamidocarboxypropionic acid, cocoamphocarboxyglycinate (also referred to as cocoamphodiacetate) and cocoamphoacetate.

Further preferred amphoteric surfactants are alkyidimethylbetaines and alkyldipolyethoxybetaines having an alkyl radical with about 8 to about 22 carbon atoms, which may be linear or branched, preferably with 8 to 18 carbon atoms and particularly preferably with about 12 to about 18 carbon atoms. These compounds are marketed, for example, by Clariant GmbH under the trade name ®Genagen LAB.

Suitable cationic surfactants are substituted or unsubstituted straight-chain or branched quaternary ammonium salts of the type $R^1N(CH_3)_3{}^{\rho}X^{\sigma}$, $R^1\ R^2N(CH_3)_2{}^{\rho}X^{94}$, $R^1R^2R^3N(CH_3)\ {}^{\rho}X^{\sigma}$ or $R^1R^2R^3R^4N^{\rho}X^{\sigma}$. The radicals $R^1$, $R^2$, $R^3$ and $R^4$, independently of one another, can preferably be unsubstituted alkyl having a chain length of between 8 and 24 carbon atoms, in particular between 10 and 18 carbon atoms, hydroxyalkyl having about 1 to about 4 carbon atoms, phenyl, $C_2$- or $C_{18}$-alkenyl, $C_7$- to $C_{24}$-aralkyl, $(C_2H_4O)_xH$, x being from about 1 to about 3, alkyl radicals containing one or more ester groups, or cyclic quaternary ammonium salts. X is a suitable anion.

Further detergent and cleaning agent ingredients which may be contained in the present invention comprise inorganic and/or organic builders for reducing the hardness of the water.

These builders may be contained in amounts by weight of about 5% to about 80% in the detergent cortpositions and cleaning compositions. Inorganic builders comprise, for example, alkali metal, ammonium and alkanolammonium salts of polyphosphates, such as, for example, tripolyphosphates, pyrophosphates and vitreous polymeric metaphosphates, phosphonates, silicates, carbonates, including bicarbonates and sesquicarbonates, sulfates and aluminosilicates.

Examples of silicate builders are the alkali metal silicates, in particular those having an $SiO_2$:$Na_2O$ ratio between 1.6:1 and 3.2:1, and sheet silicates, for example sheet sodium silicates, as described in U.S. Pat. No. 4,664,839, available from Clariant GmbH under the brand SKS®. SKS-68® is a particularly preferred sheet silicate builder.

Aluminosilicate builders are particularly preferred for the present invention. These are in particular zeolites having the formula $Na_z[(AlO_2)_z(SiO_2)_Y]_{xH2}O$, in which z and y are integers of at least 6, the ratio of z to y is between 1.0 and about 0.5, and x is an integer from about 15 to about 264.

Suitable aluminosilicate-based ion exchangers are commercially available. These aluminosilicates may have a crystalline or amorphous structure and may be naturally occurring or prepared synthetically. Processes for the preparation of aluminosilicate-based ion exchangers are described in U.S. Pat. No. 3,985,669 and U.S. Pat. No. 4,605,509. Preferred ion exchangers based on synthetic crystalline aluminosilicates are available under the name zeolite A, zeolite P(B) (including that disclosed in EP-A-0 384 070) and zeolite X. Aluminosilicates having a particle diameter between 0.1 and 10 $\mu$m are preferred.

Suitable organic builders comprise polycarboxy compounds, such as, for example, ether polycarboxylates and oxydisuccinates, as described, for example, in U.S. Pat. No. 3,128,287 and U.S. Pat. No. 3,635,830. Reference should also be made to "TMS/TDS" builders from U.S. Pat. No. 4,663,071.

Other suitable builders comprise the ether hydroxypolycarboxylates, copolymers of maleic anhydride with ethylene or vinyl methyl ether, 1,3,5-trihydroxybenzene-2,4,6-trisulfonic acid and carboxymethyloxysuccinic acid, the alkali metal, ammonium and substituted ammonium salts of polyacetic acids, such as, for example, ethylenediaminetetraacetic acid and nitrilotriacetic acid, and polycarboxylic acids, such as mellitic acid, succinic acid, oxydisuccinic acid, polymaleic acid, benzene-1,3,5-tricarboxylic acid, carboxymethyloxysuccinic acid and the soluble salts thereof.

Citrate-based builders, e.g. citric acid and its soluble salts, in particular the sodium salt, are preferred polycarboxylic acid builders, which may also be used in granulated formulations, in particular together with zeolites and/or sheet silicates.

Further suitable builders are the 3,3-dicarboxy-4-oxa-1,6-hexanedioates and the related compounds, which are disclosed in U.S. Pat. No. 4,566,984.

If phosphorus-based builders can be used, and in particular if it is intended to formulate bar soaps for washing by hand, various alkali metal phosphates, such as, for example, sodium tripolyphosphate, sodium pyrophosphate and sodium orthophosphate, may be used. Phosphonate builders, such as ethane-1-hydroxy-1,1-diphosphonate and other known phosphonates as disclosed, for example, in U.S. Pat.

No. 3,159,581, U.S. Pat. No. 3,213,030, U.S. Pat. No. 3,422,021, U.S. Pat. No. 3,400,148 and U.S. Pat. No. 3,422,137, may also be used.

The cleaning agents may contain conventional assistants or other materials which reinforce the cleaning action, serve for the treatment or care of the article to be cleaned or change the performance characteristics of the cleaning composition.

Suitable assistants comprise the substances mentioned in U.S. Pat. No. 3,936,537, for example enzymes, in particular proteases, lipases and cellulases, lather enhancers, lather retardants, discoloration and/or corrosion inhibitors, suspending agents, colorants, fillers, optical brighteners, disinfectants, alkalis, hydrotropic compounds, antioxidants, enzyme stabilizers, perfumes, solvents, solubilizers, redeposition inhibitors, dispersants, staining inhibitors, e.g. polyamine-N-oxides, such as, for example, poly(4-vinylpyridine-N-oxide), polyvinylpyrrolidone and copolymers of N-vinylimidazole and N-vinylpyrrolidone, processing assistants, softeners and antistatic agents.

The washing compositions and cleaning compositions of the present invention can, if required, contain one or more conventional bleaches, as well as activators or stabilizers, in particular peroxy acids, which do not react with the comb polymers according to the invention. In general it must be ensured that the bleaches used are compatible with the ingredients of the cleaning agent. Conventional test methods such as, for example, the determination of the bleaching activity of the ready-formulated cleaning agent as a function of storage time, can be used for this purpose.

The peroxy acid may be either a free peroxy acid or a combination of an inorganic persalt, for example sodium perborate or sodium percarbonate, and an organic peroxy acid precursor, which is converted into a peroxy acid if the combination of the persalt and the peroxy acid precursor is dissolved in water. The organic peroxy acid precursors are often referred to in the prior art as bleach activators. Examples of suitable organic peroxy acids are disclosed in U.S. Pat. No. 4,374,035, U.S. Pat. No. 4,681,592, U.S. Pat. No. 4,634,551, U.S. Pat. No. 4,686,063, U.S. Pat. No. 4,606,838 and U.S. Pat. No. 4,671,891.

Examples of compositions which are suitable for bleaching laundry and which contain perborate bleach and activators are described in U.S. Pat. No. 4,412,934, U.S. Pat. No. 4,536,314, U.S. Pat. No. 4,681,695 and U.S. Pat. No. 4,539,130.

Examples of peroxy acids which are preferred for use in this invention include the peroxydodecanedioic acid (DPDA), the nonylamide of peroxysuccinic acid (NAPSA), the nonylamide of peroxyadipic acid (NAAA) and decyl diperoxysuccinic acid (DDPSA). The peroxy acid is preferably contained in soluble granules, corresponding to the method of U.S. Pat. No. 4,374,035. Preferred bleaching granules contain, in percentages by weight, 1% to 50% of an exothermally soluble compound, such as, for example, boric acid; 1% to 25% of a surfactant active ingredient compatible with the peroxy acid, such as, for example, C13LAS; 0.1% to 10% of one or more chelate stabilizers, such as, for example, sodium pyrophosphate; and 10% to 70% of a water-soluble salt, such as, for example, sodium sulfate.

The peroxy acid-containing bleach is used in amounts which give an amount of available oxygen of from about 0.1% to about 10%, preferably from about 0.5% to about 5%, in particular from about 1% to 4%. The stated percentages relate to the total weight of the cleaning composition.

Suitable amounts of peroxy acid-containing bleach, based on a unit dose of the cleaning composition according to the invention, as used for a typical wash liquor, which comprises about 65 liters of water at 15 to 60° C., produce from about 1 ppm to about 150 ppm of available oxygen, preferably from about 2 ppm to about 20 ppm of available oxygen. The wash liquor should have a pH between 7 and 11, preferably between 7.5 and 10.5, in order to achieve an adequate bleaching result. Reference may be made to column 6, lines 1 to 10, of U.S. Pat. No. 4,374,035.

Alternatively the bleach composition may contain a suitable organic peroxy acid precursor which produces one of the abovementioned peroxy acids when it reacts with hydrogen peroxide in aqueous alkaline solution. The source of the hydrogen peroxide may be any inorganic peroxide which liberates hydrogen peroxide in aqueous solution, such as, for example, sodium perborate (monohydrate and tetrahydrate) and sodium percarbonate.

The amount of the peroxide-containing bleaches in the cleaning compositions according to the invention is from about 0.1% by weight to about 95% by weight and preferably from about 1% by weight to about 60% by weight. If the bleach composition is also a fully formulated cleaning composition, it is preferable for the amount of peroxide-containing bleach to be from about 1% by weight to about 20% by weight.

The amount of bleach activators which can be used with the comb polymers according to the invention is in general between 0.1 and 60% by weight, preferably between 0.5 and 40% by weight. If the bleach compositions used are simultaneously fully formulated detergent compositions, the amount of bleach activators which is contained in them is preferably between about 0.5 and 20% by weight.

The peroxy acid and the comb polymers according to the invention are preferably present in a weight ratio of available oxygen from the peroxy acid to comb polymers according to the invention of from about 4:1 to about 1:30, in particular from about 2:1 to about 1:15, and especially from about 1:1 to about 1:7.5. This combination may be used both as a fully formulated product and as an additive to a detergent.

The cleaning compositions according to the invention may contain one or more conventional enzymes. Such enzymes are, for example, lipases, amylases, proteases and cellulases. A preferred enzyme is cellulase. The cellulase used here may be obtained from bacteria or molds and should have an optimum pH between 5 and 9.5. Suitable cellulases are disclosed in U.S. Pat. No. 4,435,307. These are cellulase which is produced from a strain of Humicola insolens, in particular from the strain Humicola DSM 1800 or another cellulase-212-producing mold which belongs to the genus Aeromonas, and cellulase which was extracted from the hepatopancreas of certain marine molluscs. Suitable cellulases are also disclosed in GB-A-2,075,028, GB-A-2,085,275 and German Offenlegungsschrift 2,247,832.

Preferred cellulases are described in WO-91/17 243. The cleaning compositions according to the invention contain enzymes in amounts up to about 50 mg, preferably of about 0.01 mg to about 10 mg per gram of the cleaning composition. Based on the weight of the detergent compositions and cleaning compositions which contain the comb polymers according to the invention, the amount of the enzymes is at least 0.001% by weight, preferably from about 0.001% by weight to about 5% by weight, in particular from about 0.001% by weight to about 1% by weight, especially from about 0.01% by weight to about 1% by weight.

Particularly preferred enzymes are lipases which, being lipolytic enzymes, permit better removal of natural oils and fats from soiled fabrics and thus support the comb polymers according to the invention in their action, it being possible in general to achieve additive as well as synergistic effects.

The comb polymers according to the invention which are used in aqueous textile wash liquors in concentrations of about 1 to about 180 ppm, preferably in concentrations of about 30 to about 90 ppm, ensure an effective cleaning and soil-releasing treatment for polyesters, polyester/cotton/wool blends and other synthetic fabrics. The textile wash liquors are preferably alkaline with a pH of about 7 to about 11, in particular about 7.5 to about 10.5, typical detergent ingredients being present. Surprisingly, in particular as far as the pH and anionic surfactant compounds are concerned, the detergents usually contained in detergent compositions and cleaning agents can also be used in the cleaning agents according to the invention in the amounts corresponding to the prior art. They thus fulfill their usual purpose, i.e. for example the cleaning or bleaching of fabrics without having a disdvantageous effect on the soil release properties of the comb polymers according to the invention.

The comb polymers according to the invention can be used for achieving a soil release finish also in commercial fabric softeners for household use. These contain essentially softening components, co-softeners, emulsifiers, perfumes, colorants and electrolytes and are adjusted to an acidic pH of less than 7, preferably between 3 and 5.

The softening components used are quaternary ammonium salts of the type

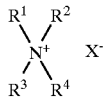

in which $R^1$ is $C_8$–$C_{24}$ n-alkyl or isoalkyl, preferably $C_{10}$–$C_{18}$ n-alkyl $R^2$ is $C_1$–$C_4$-alkyl, preferably methyl $R^3$ is $R^1$ or $R^2$ $R^4$ is $R^2$ or hydroxyethyl or hydroxypropyl or oligomers thereof $X^-$ is bromide, chloride, iodide, methosulfate, acetate, propionate or lactate.

Examples of these are distearyldimethylammonium chloride, di-tallow-alkyldimethylammonium chloride, di-tallow-alkylmethylhydroxypropylammonium chloride, cetyltrimethylammonium chloride, or the corresponding benzyl derivatives, such as, for example, dodecyidimethylbenzylammonium chloride. Cyclic quaternary ammonium salts, such as, for example, alkylmorpholine derivatives, can also be used.

In addition to the quaternary ammonium compounds, imidazolinium compounds (1) and imidazoline derivatives (2) may also be used:

(1)

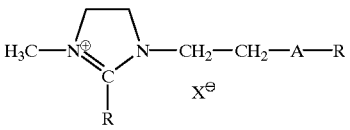

-continued (2)

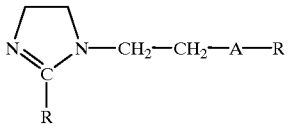

in which

R is $C_8$–$C_{24}$ n-alkyl or isoalkyl, preferably $C_{10}$–$C_{18}$ n-alkyl

X is bromide, chloride, iodide or methosulfate

A is —NH—CO—, —CO—NH—, —O—CO— or —CO—O—.

A particularly preferred class of compound comprises the so-called esterquats. These are reaction products of alkanolamines and fatty acids, which are then quaternized with customary alkylating or hydroxyalkylating agents.

Preferred alkanolamines are compounds according to the formula

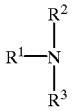

in which $R^1$ is $C_1$–$C_3$ hydroxyalkyl, preferably hydroxyethyl and $R^2$ and $R^3$ are $R^1$ or $C_1$–$C_3$ alkyl, preferably methyl.

Triethanolamine and methyldiethanolamine are particularly preferred.

Further particularly preferred starting materials for esterquats are aminoglycerol derivatives, such as, for example, dimethylaminopropanediol.

Alkylating and hydroxyalkylating agents are alkyl halides, preferably methyl chloride, dimethyl sulfate, ethylene oxide and propylene oxide.

Examples of esterquats are compounds of the formulae:

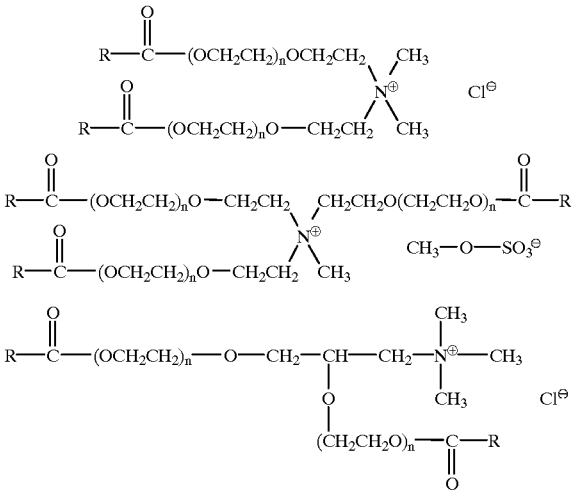

in which R—C—O is derived from $C_8$–$C_{24}$-fatty acids which may be saturated or unsaturated. Examples of these are caproic acid, caprylic acid, hydrogenated or unhydrogenated or only partially hydrogenated tallow fatty acids, stearic acid, oleic acid, linolenic acid, behenic acid, palmitic-stearic acid, myristic acid and elaidic acid. n is in the range from 0 to 10, preferably from 0 to 3, particularly preferably from 0 to 1.

Further preferred fabric softener raw materials with which the comb polymers according to the invention may be combined are amidoamines based on, for example, dialkyltriamines and long-chain fatty acids, and their oxethylates or quaternized variants. These compounds have the following structure:

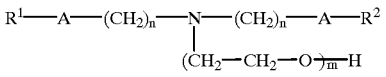

in which $R^1$ and $R^2$, independently of one another, are $C_8$–$C_{24}$ n-alkyl or isoalkyl, preferably $C_{10}$–$C_{18}$ n-alkyl, A is —CO—NH— or —NH—CO—, n is 1–3, preferably 2, and m is 1–5, preferably 2–4.

By quaternizing the tertiary amino group, it is additionally possible to introduce a radical $R^3$, which may be $C_1$–$C_4$-alkyl, preferably methyl, and an opposite ion X, which may be chloride, bromide, iodide or methylsulfate. Amidoaminooxethylates and their quaternized secondary products are available under the trade names ®Varisoft 510, ®Varisoft 512, ®Rewopal V 3340 and ®Rewoquat W 222 LM.

The preferred use concentrations of the comb polymers according to the invention in the softener formulations correspond to those mentioned for detergent formulations.

In addition to the stated applications in detergents and softeners/fabric aftertreatment compositions, the comb polymers according to the invention can be used in all household cleaning agents and all industrial cleaning agents for achieving a good soil release effect in relation to hydrophobic dirt. The household cleaning agents and industrial cleaning agents may contain the abovementioned representative examples of surfactants, builders, optical brighteners, bleaches and enzymes.

Examples of household cleaning agents are all-purpose cleaners, dishwashing compositions, carpet cleaning and impregnating compositions, cleaning and care compositions for floors and other hard surfaces, for example of plastic, ceramic or glass.

Examples of industrial cleaning agents are plastics cleaning and care compositions, for example for housings and dashboards, and cleaning and care compositions for coated surfaces such as, for example, automotive bodywork.

Liquid cleaning formulations which contain the comb polymers according to the invention generally have a pH of less than 8.

EXAMPLES

Example 1

220 g of dimethyl terephthalate, 92 g of 5-sulfoisophthalic acid dimethyl ester monosodium salt, 140 g of ethylene glycol, 212 g of 1,2-propylene glycol, 149 g of 72.4% strength sodium hydroxyethoxyethanesulfonate, 7.4 g of polyacrylic acid having an average molecular weight of 2000, 0.4 g of anhydrous sodium acetate and 0.3 g of titanium tetraisopropylate were initially introduced into a 11 four-necked flask having a KPG stirrer, 20 cm Vigreux column with Claisen bridge, internal thermometer and gas inlet tube. Thereafter, the content was blanketed with nitrogen and heated to 165–167° C. in the course of half an hour. The temperature was increased to 210–220° C. in the course of a further 2.5 hours. At an internal temperature of about 165° C., the transesterification or esterification began and hence the distillation of methanol and water. After about 5 hours, more than 95% of the expected amount had distilled off. In the course of about 1 hour, the pressure was then reduced to 1–5 mbar and condensation was effected for a further 2.5 hours at 220–225° C., a mixture of ethylene glycol and 1,2-propylene glycol distilling off and the batch becoming increasingly viscous but still remaining stirrable. After the end of the condensation, flashing with nitrogen was effected and cooling was carried out. The product solidified on cooling to room temperature to give a solid brittle mass. Yield 440 g.

Comb polymers according to the invention were prepared analogously to example 1, using the following starting materials:

Example 2

310 g of dimethyl terephthalate
130 g of ethylene glycol
200 g of 1,2-propylene glycol
140 g of 72.4% strength sodium hydroxyethoxyethanesulfonate
73 g of 80.5% strength sodium dihydroxypropoxyethanesulfonate
9.6 g of polyacrylic acid (average molecular weight 2000)
0.4 g of anhydrous sodium acetate
0.3 g of titanium tetraisopropylate
Yield 510 g

Example 3

290 g of dimethyl terephthalate
126 g of ethylene glycol
220 g of 1,2-propylene glycol
120 g of monosodium 3-sulfobenzoate
88 g of 80.5% strength sodium dihydroxypropoxyethanesulfonate
7.7 g of polyacrylic acid (average molecular weight 2000)
0.4 g of anhydrous sodium acetate
0.3 g of titanium tetraisopropylate
Yield 510 g

Example 4

272 g of dimethyl terephthalate
140 g of ethylene glycol
245 g of 1,2-propylene glycol
125 g of monosodium 3-sulfobenzoate
83 g of 5-sulfoisophthalic acid dimethyl ester sodium salt
6.7 g of polyacrylic acid (average molecular weight 2000)
0.5 g of arnhydrous sodium acetate
0.4 g of titanium tetraisopropylate
Yield 520 g

Example 5

255 g of dimethyl terephthalate
130 g of ethylene glycol
230 g of 1,2-propylene glycol
118 g of monosodium 3-sulfobenzoate
78 g of 5-sulfoisophthalic acid dimethyl ester sodium salt
6.3 g of polyacrylic acid (average molecular weight 100,000)

98 g of triethylene glycol 0.4 g of anhydrous sodium acetate 0.3 g of titanium tetraisopropylate Yield 520 g Example 6

291 g of dimethyl terephthalate 150 g of ethylene glycol 230 g of 1,2-propylene glycol 80 g of 5-sulfoisophthalic acid dimethyl ester Na salt 89 g of 5-sulfoisophthalic acid dimethyl ester sodium salt 160 g of 72.4% strength sodium hydroxyethoxyethanesulfonate 4.4 g of polyvinyl alcohol (average molecular weight 100,000)

0.5 g of anhydrous sodium acetate 0.4 g of titanium tetraisopropylate

Yield 530 g

The comb polymers according to the invention were compared with soil release polymers of the prior art, with regard to their soil release effect.

For this purpose, the substances were added in a concentration of 1% in each case to a phosphate-containing and phosphate-free washing powder. Polyester WFK 30 A test fabric (Waschereiforschungsanstalt Krefeld) was prewashed with these washing powders. The fabric thus pretreated was dried and were surface-soiled with spent motor oil. After an action time of 1 hour, the test fabric was washed with the same washing powders. For comparison, test fabric was washed both without addition of soil release polymers and with addition of 1% of commercial soil release polymers. For assessing the soil release, the reflectance of the test fabrics was measured. The following compounds were used as soil release polymers of the prior art:

Comparative Example 1

®Repel-O-Tex SRP 4, from Rhodia, 70% of active substance, used in a concentration of 1%, based on the active substance.

Comparative Example 2

®Sokalan HP 40, from BASF, 25% of active substance, used in a concentration of 1%, based on the active substance.

TABLE 1

| Washing conditions | |
|---|---|
| Washing machine: | Linitest |
| Water hardness: | 20° dH |
| Liquor ratio: | 1:40 |
| Washing temperature: | 40° C. |
| Washing time: | 30 min |
| Detergent concentration: | 6 g/l |

The washing powders used were the following standard detergents of the Wäschereiforschungsanstalt Krefeld:

IEC-A (phosphate-free washing powder)

IEC-B (phosphate-containing washing powder)

Table 2: Results of washing with the comb polymers according to the invention in comparison with the soil release polyesters of the prior art in the phosphate-free washing powder IEC-A:

| IEC-A | Reflectance (%) |
|---|---|
| Without addition | 23.1 |
| + 1% of soil release polymer: | |
| Comparative Example 1 | 24.8 |
| Comparative Example 2 | 26.5 |
| + 1% of comb polymer: | |
| Example 1 | 36.6 |
| Example 2 | 36.0 |
| Example 3 | 37.9 |
| Example 4 | 37.1 |
| Example 5 | 36.5 |
| Example 6 | 38.8 |

Table 2: Results of washing with the comb polymers according to the invention in comparison with the soil release polyesters of the prior art in the phosphate-containing washing powder IEC-B:

| IEC-B | Reflectance (%) |
|---|---|
| Without addition | 24.5 |
| + 1% of soil release polymer: | |
| Comparative Example 1 | 25.7 |
| Comparative Example 2 | 27.3 |
| + 1% of comb polymer: | |
| Example 1 | 38.1 |
| Example 2 | 37.0 |
| Example 3 | 38.4 |
| Example 4 | 37.7 |
| Example 5 | 37.3 |
| Example 6 | 38.7 |

List of trade names used

IEC-A/phosphate-free washing powder Wäschereiforschungs-Anstalt Krefeld

IEC-B/phosphate-containing washing powder Wätschereiforschungs-Anstalt Krefeld

®Repel-O-Tex SRP 4/70% of ethylene glycol/polyethylene

Rhodia glycol terephthalic acid copolymer, remainder sodium sulfate and sodium aluminum silicate ®Sokalan HP 40/25% of nonionic polycondensate on 75% BASF of zeolite A

What is claimed is:

1. Detergents and cleaning agents comprising a comb polymer obtained by condensation of a) a polycarboxylic acid or a polymeric alcohol as the backbone, both having a molecular weight from 1000 to 2,000,000 g/mol, b) one or more optionally sulfo-substituted polyalcohols having 2 to 4 OH groups or polyglycols of the formula $HO—(XO)_a—H$, in which X is $C_2H_4$ and/or $C_3H_7$ and a is a number from 2 to 35, c) one or more optionally sulfonated $C_2$–$C_{10}$-dicarboxylic acids and d) one or more compounds of the formulae $NH_2R$, $NHR_2$, ROH, $R^1COOH$, $HO(XO)_b—H$ and $HO(CH_2CH_2)_d SO_3K$, in which R is $C_1$–$C_{22}$-alkyl or $C_6$-$C_{10}$-aryl, $R_1$ is $C_1$–$C_{22}$-alkyl, $C_1$–$C_{22}$-sulfoalkyl, $C_6$–$C_{10}$-aryl or $C_6$–$C_{10}$-sulfoaryl, X is $C_2H_4$ and/or $C_3H_7$, b is a number from 3 to 40, d is a number from 1 to 10, and K is a cation, as soil release polymers.

2. The detergents and cleaning agents as claimed in claim 1, wherein the comb polymers comprise 0.5 to 10% by weight of the component a), 15 to 45% by weight of component b), 30 to 70% by weight of the component c) and 10 to 30% by weight of component d).

3. The use of comb polymers as claimed in claim 1, wherein the component a) is polyacrylic acid, polymethacrylic acid, polymaleic acid, polymaleic anhydride, polynorbornenic acid or the $C_1$–$C_{22}$-esters thereof, polyvinyl alcohol or polynorbornyl alcohol.

4. The use of comb polymers as claimed in claim 1, wherein the component b) is ethylene glycol, 1,2-propanediol, 1,2-butanediol, 1,4-butanediol, sodium 1,2-dihydroxypropoxyethanesulfonate, glycerol or pentaerythritol.

5. The use of comb polymers as claimed in claim 1, wherein the component c) is terephthalic acid, isophthalic acid, cyclohexanedicarboxylic acid, succinic acid, adipic acid, 2,6-naphthalenedicarboxylic acid, sulfosuccinic acid or 5-sulfoisophthalic acid.

6. The use of comb polymers as claimed in claim 1, wherein the component d) is a compound of the formula $H(OCH_2CH_2)_dSO_3M$, in which d is a number from 1 to 10 and M is an alkali metal or alkaline earth metal cation.

7. The detergents and cleaning agents of claim 1 adapted for textiles, washing aids, fabric aftertreatment compositions and cleaning agents for hard surfaces.

8. The detergents and cleaning agents as claimed in claim 1 in the form of aqueous solutions or formulations adapted for achieving a soil release finish on textiles.

9. The detergents and cleaning agents as claimed in claim 1 in liquid, pasty, gel-like or granulated form.

10. The detergents and cleaning agents of claim 1 wherein in b), of said $HO—(XO)_a—H$ , a is a number from 2 to 5, and in d) of said $HO(XO)_b—H$, b is a number from 3 to 20 and of said $HO(CH_2CH_2)_dSO_3K$, d is a number from 1 to 4.

* * * * *